US007914282B2

(12) United States Patent
Al-Hasan et al.

(10) Patent No.: US 7,914,282 B2
(45) Date of Patent: Mar. 29, 2011

(54) APPARATUS FOR REDUCING POLLUTION FROM A FLARE STACK

(76) Inventors: Khaled Jafar Al-Hasan, Safat (KW); Ahmad Mohammad Al-Ali, Bayan (KW)

( * ) Notice: Subject to any disclaimer, the term of this patent is extended or adjusted under 35 U.S.C. 154(b) by 1118 days.

(21) Appl. No.: 11/619,937

(22) Filed: Jan. 4, 2007

(65) Prior Publication Data

US 2008/0163594 A1 Jul. 10, 2008

(51) Int. Cl.
*F23G 7/08* (2006.01)

(52) U.S. Cl. ..... 431/202; 431/5; 431/182; 431/185; 55/315; 55/385.1; 55/391; 110/344; 110/345; 110/346; 96/48; 96/64; 96/108

(58) Field of Classification Search ..... 431/202, 431/201, 5, 182, 185, 355, 159; 55/385.1, 55/315, 348, 391, 413; 422/168; 110/344, 110/345, 346; 96/48, 64, 107, 108
See application file for complete search history.

(56) References Cited

U.S. PATENT DOCUMENTS 3,893,829 A * 7/1975 Valentino ..... 96/252
4,101,261 A * 7/1978 Straitz, III ..... 431/202
2004/0262241 A1* 12/2004 Socha ..... 210/760

* cited by examiner

*Primary Examiner* — Carl D Price
*Assistant Examiner* — Avinash Savani
(74) *Attorney, Agent, or Firm* — Lowe Hauptman Ham & Berner, LLP

(57) ABSTRACT

Apparatus for reducing pollution from a flare stack includes a platform disposed on or near the top of the flare stack and a plurality of baffles and filters disposed on the platform. A first plurality of upwardly extending stainless steel baffles is disposed around the flare stack while a second plurality of baffles is disposed about the outer periphery of the platform. A first and a second plurality of filters are disposed between the first and second plurality of baffles. The first plurality of filters associated with a fan, blower or pump for drawing flare gas into and out of the filter.

2 Claims, 3 Drawing Sheets

APPARATUS FOR REDUCING POLLUTION FROM A FLARE STACK

FIELD OF THE INVENTION

This invention relates to an apparatus for reducing pollution from a flare gas stack and more particularly to a combination of a flare gas stack for waste combustible gases from industrial processes and an apparatus for reducing pollution from such stacks.

BACKGROUND FOR THE INVENTION

In many areas of the world, environmental concerns have focused on industrial pollution, efforts to reduce such pollution, global warming, acid rain and protection of the ozone layer. It has also been recognized that waste combustible gases from industrial processes including petrochemical processes may contribute to harmful pollution. As a result, there have been numerous attempts to control emissions, namely in the form of flare gases.

One approach to control flare gas emissions is disclosed in a U.S. patent of Straitz et al., U.S. Pat. No. 4,139,339. As disclosed therein provisions are made for start-up, steady state or transient purged gas control and for failure of the purged gas supply. It also takes into account variable wind speed at or near the top of the stack, flow or non-flow of purge gas and waste gas in the stack. The patent also teaches provisions for ambient temperature and temperatures of the advancing gaseous medium in the stack, oxygen content of the gases, pilot burner gas supply and ignition with protection against pilot burner operation under undesirable conditions. A control panel is also provided so that an operator can take appropriate action when necessary.

A more recent approach to flare apparatus and methods are disclosed in the U.S. Pat. No. 5,846,068 of Schwartz et al. The Schwartz patent discloses an improved flare apparatus for burning flammable gas and air. The apparatus includes an outer tubular member and an inner tubular member positioned within the outer tubular member whereby an annular flammable gas discharge space is provided immediately adjacent to an annular air discharge space. The flammable gas is discharged into the atmosphere in an annular straight out pattern. At least a portion of the air is discharged into the atmosphere for mixing with the flammable gas in a swirling pattern immediately adjacent to the flammable gas which prevents internal burning and premature failure of the flare apparatus.

A further approach to burning stack gas is disclosed in a U.S. patent of Rajewski, U.S. Pat. No. 5,865,613. The Rajewski patent discloses a flare stack with a smokeless burn and reduced steam consumption. The flare stack includes a central pipe having a flare tip with a flare tip edge. An outer pipe surrounds the central pipe and forms an annulus between them. A spreader spreads gas from the central pipe into the annulus. Steam and air with oxygen are forced into the base of the annulus and past of the spreader to mingle with the gas and create smokeless burning. Steam and air are supplied by at least one conical conduit leading into the annulus, the conduit having an inlet for the flow of steam into it. A steam manifold having an outlet corresponding to each conduit, and each outlet being directed towards a corresponding inlet in the conduit are provided. In addition, an opening between each outlet and inlet for the flow of air into each conduit is drawn by a ventory effect.

Notwithstanding the above, it is presently believed that there is a need and a potential market for an improved apparatus for reducing pollution from a flare gas stack. There should be a demand for such apparatus since it will reduce pollution and reduce additional heat, acid rain and adverse effect on the ozone layer. In addition, the improved apparatus does not require burning of additional gases or added steam or oxygen to the flare gas. Further, it is presently believed that the apparatus in accordance with the present invention will have few moving parts and will be of durable construction.

BRIEF SUMMARY OF THE INVENTION

In essence, the present invention contemplates an improved apparatus for reducing pollution from a flare stack. The apparatus includes a first plurality of baffles and a support means such as a generally horizontal circular platform having an outer periphery disposed on the top of or near the top of a flare stack. The platform supports a first plurality of baffles at the top of the flare stack with the first plurality of baffles arranged in a generally circular configuration around the top of the flare stack and on an inner portion of the platform. The first plurality of baffles extends upwardly from the platform with a space between adjacent baffles. The space is about equal to the width of an adjacent baffle. This first plurality of baffles directs a portion of the flare gas upwardly above the flare gas stack while allowing a portion of the gas to flow outwardly between the first pluralities of baffles.

The apparatus also includes a second plurality of upwardly extending arcuate baffles disposed on the platform around the outer periphery thereof. Each of the baffles defines a pair of adjacent arcuate sections.

The apparatus also includes a first plurality of filters disposed on the platform between the first and second plurality of baffles and means for drawing a portion of flare gas into and through the first plurality of filters and directing the portion of flare gas below the platform. The apparatus also includes a second plurality of filters having the shape of a right circular cylinder for absorbing pollutants from the flare gas.

The invention will now be described in connection with the accompanying drawings wherein like reference numbers have been used to designate like parts.

DESCRIPTION OF THE PREFERRED EMBODIMENTS OF THE INVENTION

Figure 1:
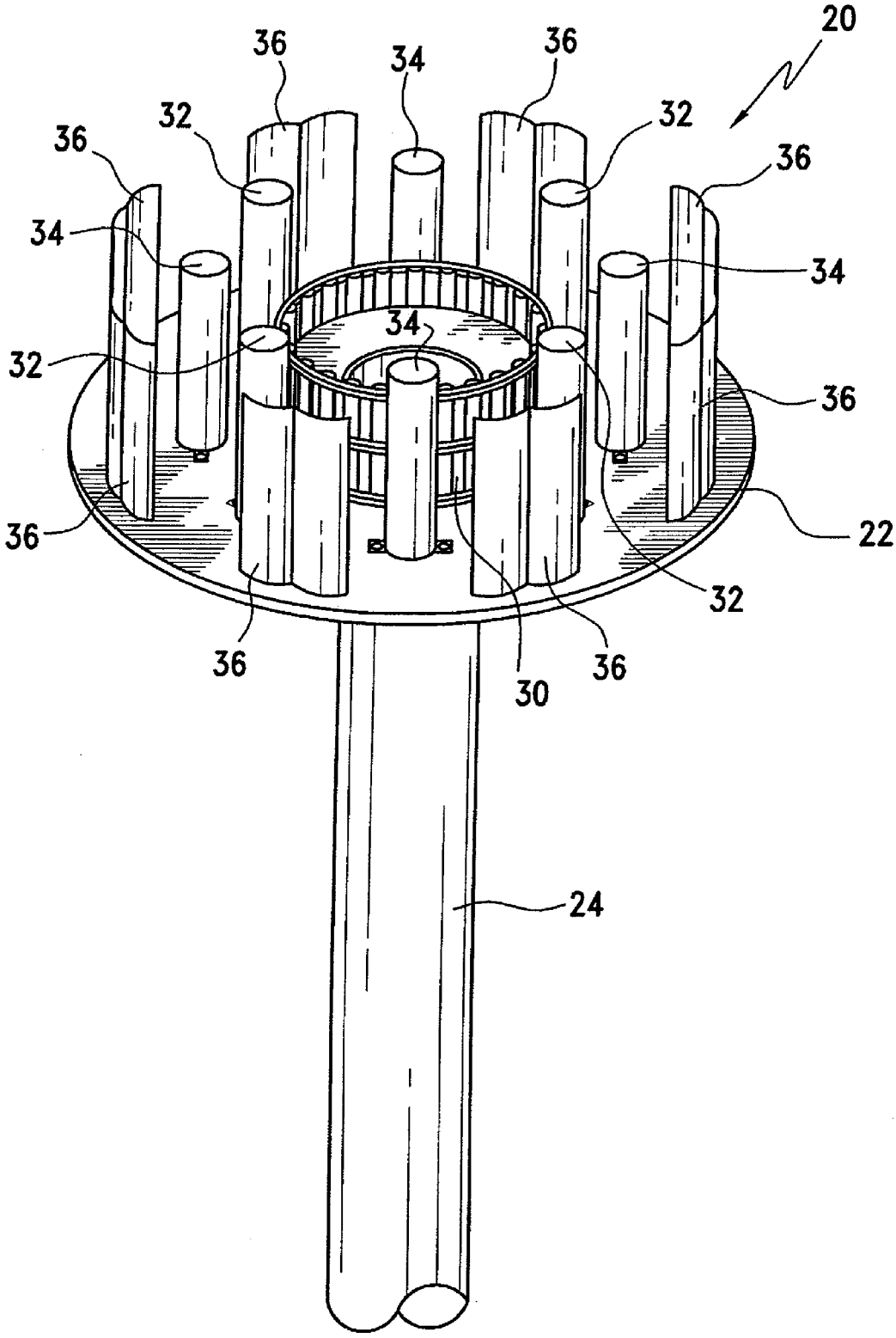
FIG. 1 is a perspective view of an apparatus for reducing pollution from a flare stack in accordance with the present invention.
Figure 2:
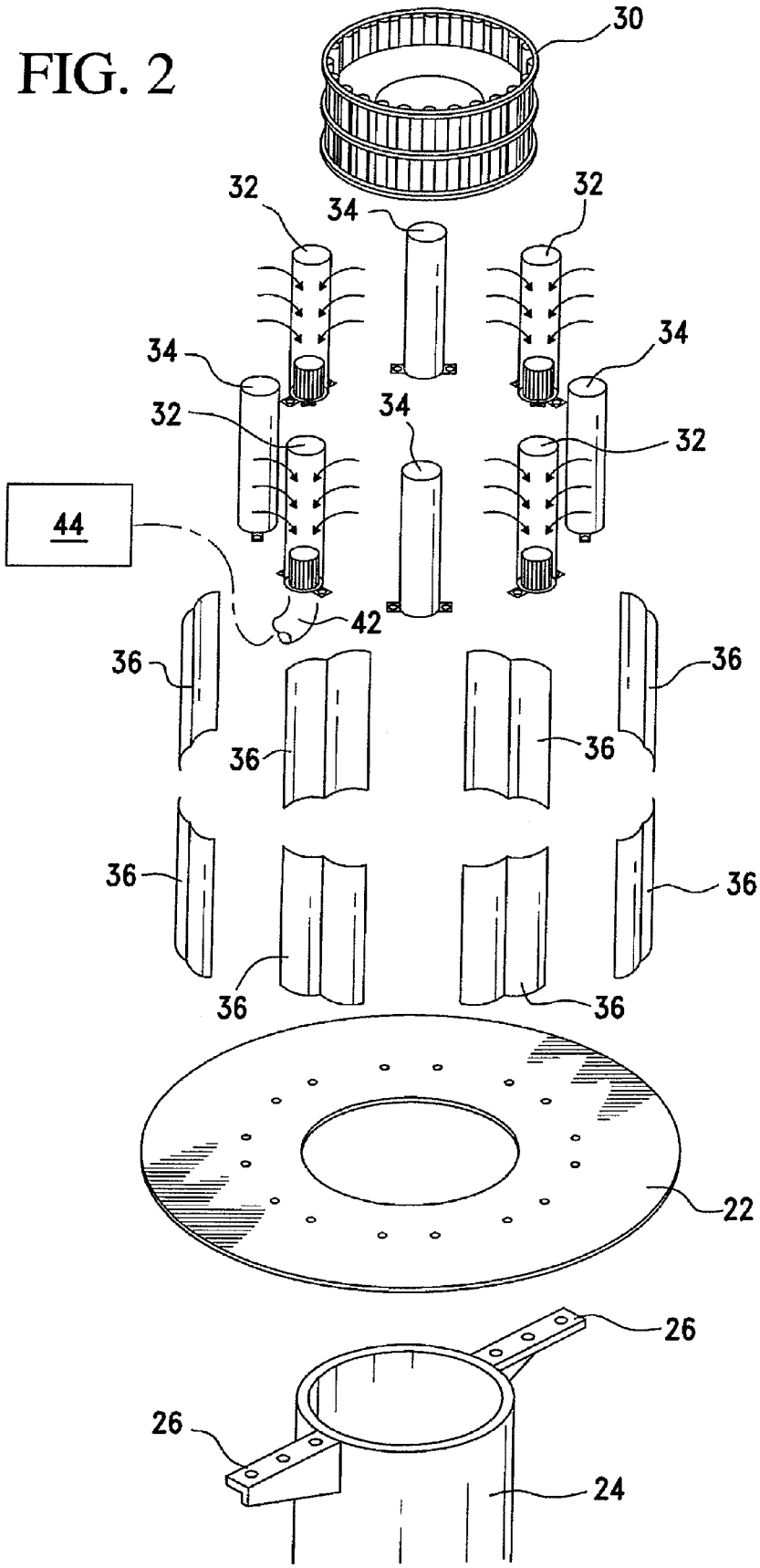
FIG. 2 is an exploded perspective view of the apparatus shown in Figure one.
Figure 3:
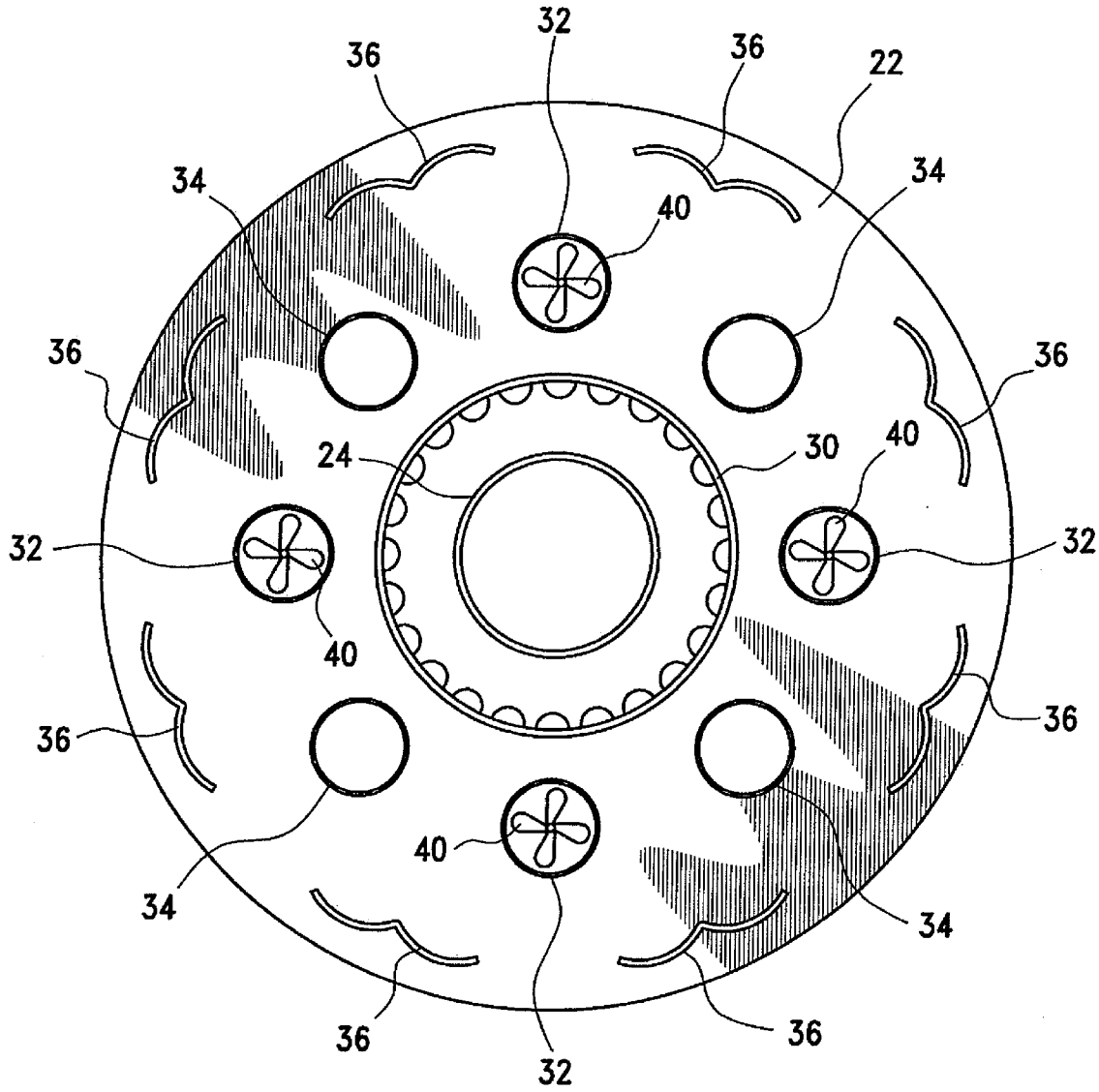
FIG. 3 is a top or plan view of a platform, blowers and baffles as used in the present invention.

As illustrated, in FIGS. 1-3, an apparatus 20 for reducing pollution from a flare stack includes a supporting means such as a generally circular horizontal platform 22 disposed at the top or near the top of a flare stack 24. The platform 24 may for example be supported by a pair of brackets 26 (shown in FIG. 2) or other conventional means as will be well understood by person of ordinary skill in the art.

The apparatus 20 also includes a first plurality of stainless steel upright baffles 30 disposed on the platform 22 and extending upwardly by a distance of about 20-30% preferable about 25% of the diameter of the platform 22. The stainless steel baffles 30 are disposed in a circular array around the flare stack 24 for extending the height of the flare stack but providing a diameter of about 50% larger than the flare stack. These first plurality of baffles 30 direct a portion of gas and pollutants upwardly while allowing a portion of gas and pollutants to pass laterally through the openings between the first plurality of baffles. It is also believed that the baffles will cause a certain amount of turbulence which will cause pollutants and flare gases to impact on the first and second plurality of filters 32 and 34 respectfully.

The apparatus also includes a second plurality of upwardly extending stainless steel baffles 36 each of which define a pair of adjacent arcuate sections. In the preferred embodiment of the invention, the adjacent sections form a shallow "w". These baffles 36 are at or near the outer edge of the platform 22 and spaced apart to reflect a portion of the flare gas and pollutants back toward a first and second plurality of upwardly extending filters that have a generally right circular cross section.

Means such as a fan, pump or blower 40 are disposed on or below each of the four filters 32 and are constructed and arranged for drawing flare gas and/or pollution into the central hollow areas of the filters 32. The gas and/or pollutants are then exhausted below the platform 32 to a pipe 42 and into a storage tank 44 or are recycled back into the flare stack 24.

The second plurality of filters 34 are treated with a suitable absorbent such as silica gel for absorbing flare gases. Further, a sensor (not shown) such as an oxygen sensor may be provided to monitor the composition of the gases and/or the combustion product. Other sensors may be used depending on the type of pollutant being monitored.

Inside each perforated cylinder there is a catalyst for filter made of ceramic, other filtering material that will filter out the remaining combustion product (smoke, smog, fire powder) and moisture, while the gas flows through.

While the invention has been described in connection with its preferred embodiment, it should be recognized that changes and modifications can be made therein without departing from the scope of the appended claims.

What is claimed is:

1. An apparatus for reducing pollution from a flare stack said apparatus comprising:

a first plurality of stainless steel baffles and support means having an outer periphery for supporting said first plurality of baffles at the top of a flare stack with the first plurality of baffles disposed around the top of the flare stack and extending upwardly with spaces therebetween for directing a first portion of flare gases upwardly and allowing a second portion of flare gases to flow between said first plurality of baffles in a generally lateral direction;

a second plurality of eight upwardly extending stainless steel baffles disposed on said support means outwardly from said first plurality of baffles around the periphery of said support means and in which said upwardly extending baffles in said second set of baffles have a height about twice that of said baffles in said first set of baffles;

a first plurality of four filters disposed on said support means between said first and second plurality of baffles and means for moving a portion of flare gas into and through said first plurality of filters for directing a portion of flare gases into said first plurality of filters and below said support means;

a second plurality of four filters disposed on said support means between said first and second plurality of baffles around the top of said flare stack and interspaced between said first plurality of filters and wherein said second plurality of filters are treated with a suitable absorbent for absorbing flare gases and in which each of said eight filters have the shape of a right circular cylinder and are disposed in a generally vertical position; and wherein each one of said eight baffles includes two arcuate segments with two concave portions each of which faces the flare stack and wherein the adjacent sections form a shallow "w".

2. A flare gas stack for waste combustible gases from industrial processes consisting of the following combination:

a flare stack extending upwardly in a generally vertical direction for exhausting flare gas into the atmosphere;

a first plurality of stainless steel baffles and support means having an outer periphery for supporting said first plurality of baffles at the top of a flare stack with the first plurality of baffles disposed around the top of the flare stack and extending upwardly with spaces therebetween for directing a first portion of flare gases upwardly and allowing a second portion of flare gases to flow between said first plurality of baffles in a generally lateral direction;

a second plurality of eight upwardly extending stainless steel baffles disposed on said support means outwardly from said first plurality of baffles around the periphery of said support means and in which said upwardly extending baffles in said second set of baffles have a height about twice that of said baffles in said first set of baffles;

a first plurality of four filters disposed on said support means between said first and second plurality of baffles and means for moving a portion of flare gas into and through said first plurality of filters and below said support means; and a second plurality of four filters disposed on said support means between said first and second plurality of baffles around the top of said flare stack and interspaced between said first plurality of filters and wherein said second plurality of filters are treated with a silica gel for absorbing flare gases and in which each of said eight filters have the shape of a right circular cylinder and are disposed in a generally vertical position; and wherein each one of said eight baffles include two arcuate segments with two concave portions each of which face the flare stack wherein the adjacent sections form a shallow "w".

* * * * *